United States Patent [19]

Stern

[11] 4,446,448

[45] May 1, 1984

[54] BIASING MAGNET HOLDER-TUNING CAP FOR DIELECTRIC WAVEGUIDE CIRCULATOR

[75] Inventor: Richard A. Stern, Allenwood, N.J.

[73] Assignee: The United States of America as represented by the Secretary of the Army, Washington, D.C.

[21] Appl. No.: 407,869

[22] Filed: Aug. 13, 1982

[51] Int. Cl.[3] ..... H01P 1/383

[52] U.S. Cl. ..... 333/1.1; 333/248

[58] Field of Search ..... 333/1.1, 24.1, 24.2

[56] References Cited

U.S. PATENT DOCUMENTS

| | | | |
|---|---|---|---|
| 3,355,679 | 11/1967 | Carr | 333/1.1 |
| 3,673,518 | 6/1972 | Carr | 333/1.1 |
| 3,710,280 | 1/1973 | Buck | 333/1.1 |
| 3,886,497 | 5/1975 | Helszajn | 333/1.1 |
| 4,415,871 | 11/1983 | Stern et al. | 333/1.1 |

FOREIGN PATENT DOCUMENTS

| | | | |
|---|---|---|---|
| 57-65915 | 4/1982 | Japan | 333/1.1 |

*Primary Examiner*—Paul L. Gensler

*Attorney, Agent, or Firm*—Anthony T. Lane; Jeremiah G. Murray; John W. Redman

[57] ABSTRACT

A Y-junction dielectric waveguide circulator is provided with a dielectric support plate. At the vertex of adjacent dielectric waveguides are positioned metal tuning legs. These tuning legs are spaced from the waveguides and extend higher than them. Preferably the tuning legs are made integral with a cap positioned above the circulator junction. This cap also serves as a holder for the upper biasing magnet. The lower magnet is centered under the junction and bonded to the bottom of the support plate.

8 Claims, 5 Drawing Figures

BIASING MAGNET HOLDER-TUNING CAP FOR DIELECTRIC WAVEGUIDE CIRCULATOR

The invention described herein may be manufactured, used and licensed by or for the Government for Governmental purposes without the payment to me of any royalties thereon.

BACKGROUND OF THE INVENTION

This invention relates generally to millimeter wavelength, electromagnetic energy, dielectric waveguide transmission line components, and more particularly to a dielectric waveguide circulator.

Y-junction circulators for use with microwave transmission lines and components are well known in the art. See, for example, U.S. Pat. Nos. 3,355,679 and 3,673,518. As described in these patents, an important part of the design of components such as circulators is minimizing losses which result when impedances are not adequately matched.

Millimeter wave dielectric circulators have been previously developed. In U.S. patent application Ser. No. 310,542, filed Oct. 1, 1981, now U.S. Pat. No. 4,415,871, embodiments of dielectric waveguide circulators are disclosed. In considering further the Y-junction circulator revealed in that application, an effort was made to reduce the insertion loss of the circulator without incurring undue complexity and expense.

SUMMARY OF THE INVENTION

A Y-junction dielectric waveguide circulator having a supporting dielectric plate holding the three dielectric waveguides and the ferrite junction is provided with a metal tuning cap having legs positioned between and spaced from the dielectric waveguides. The cap also serves as a support and holder for the upper biasing magnet.

DESCRIPTION OF THE PREFERRED EMBODIMENT

Figure 1:
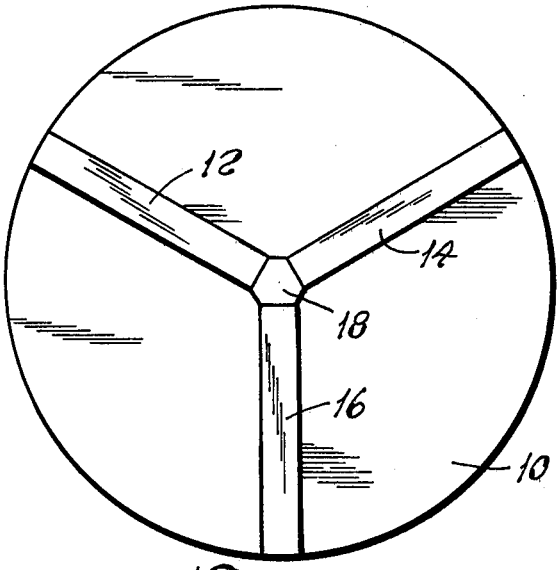
FIG. 1 is a plan view representing a dielectric Y-junction circulator with a dielectric support plate.

Referring to FIG. 1, dielectric support plate 10 has mounted thereon dielectric waveguides 12, 14 and 16 and ferrite junction 18 forming a Y-junction circulator. As illustrated, ferrite junction 18 is a right, triangular prism. Dielectric waveguides 12, 14 and 16 and ferrite junction 18 are bonded to support plate 10 with, for example, a polyethylene bond. (Such a bonded dielectric support arrangement is more fully disclosed in U.S. patent application Ser. No. 394,753, filed July 2, 1982). Also, the ends of dielectric waveguides 12, 14 and 16 are bonded to junction 18 with a low loss adhesive. (An unsupported circulator of this type is fully described in U.S. patent application Ser. No. 310,542, filed Oct. 1, 1981.)

Figure 2:
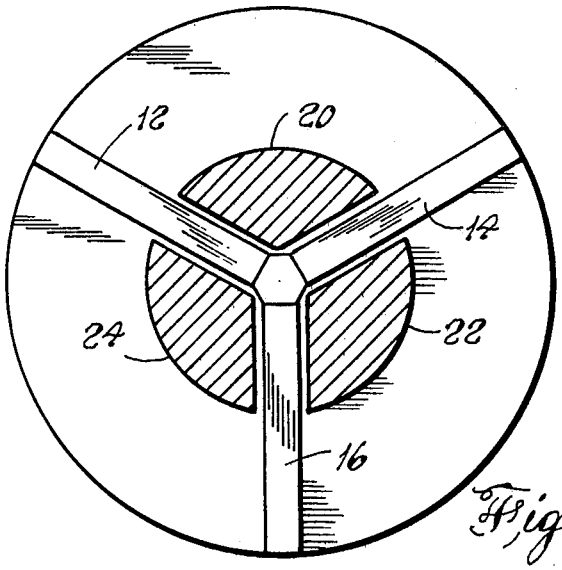
FIG. 2, taken along line 2—2 of FIG. 4, represents the circulator of FIG. 1 with the addition of tuning legs.
Figure 4:
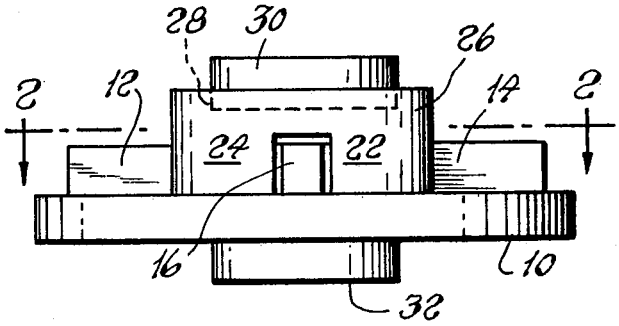
FIG. 4 is an elevation of FIG. 3.

In FIG. 2, the circulator elements of FIG. 1 are shown with tuning legs 20, 22 and 24 positioned between dielectric waveguides 12, 14 and 16. Tuning legs 20, 22 and 24 are metal. It will be noted that tuning legs 20, 22 and 24 are spaced from dielectric waveguides 12, 14 and 16, and, as is shown in FIG. 4, the tuning legs extend higher than the dielectric waveguides. The sides of the tuning legs adjacent to the dielectric waveguides are, as shown, parallel thereto. The distance between the tuning legs and the dielectric waveguides and the height of the tuning legs have been arrived at by experiment and will change with the center frequency at which the circulator is to operate. In one circular constructed in accordance with the invention, the waveguides were 1.3 mm wide and 1.8 mm high. The tuning legs were spaced from the dielectric waveguides 1.8 mm, and were 2.0 mm high.

Figure 3:
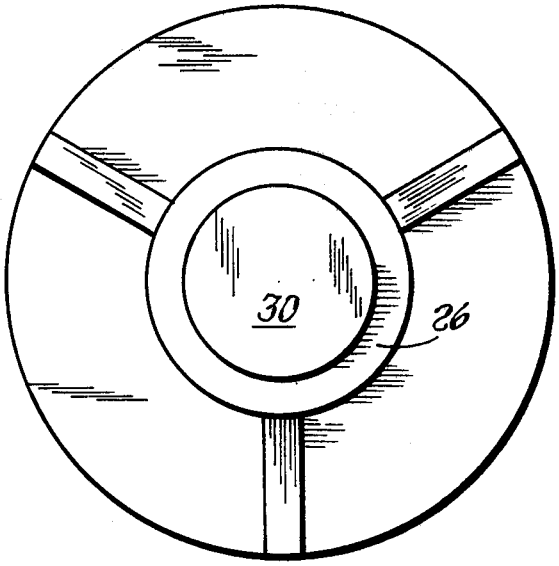
FIG. 3 represents the circulator of FIGS. 1 and 2 showing the metal cap and a magnet added.

As shown in FIGS. 3 and 4, tuning legs 20, 22 and 24 are preferably made an integral part of metal cap 26. Metal cap 26 is provided with a cylindrical recess or dished portion 28 which serves as a holder for biasing magnet 30. Tuning legs 20, 22 and 24 and cap 26 may be fabricated of any good conductive metal, e.g. copper. A biasing magnet 32 is bonded to the bottom of support plate 10. The direction of bias or polarity determines which waveguide will act as the output for energy received in ferrite junction 18 from another dielectric waveguide.

Although tuning cap 26 with tuning legs 20, 22 and 24 is preferably made as an integral structure, it will be evident that these can be separately fabricated elements.

Figure 5:
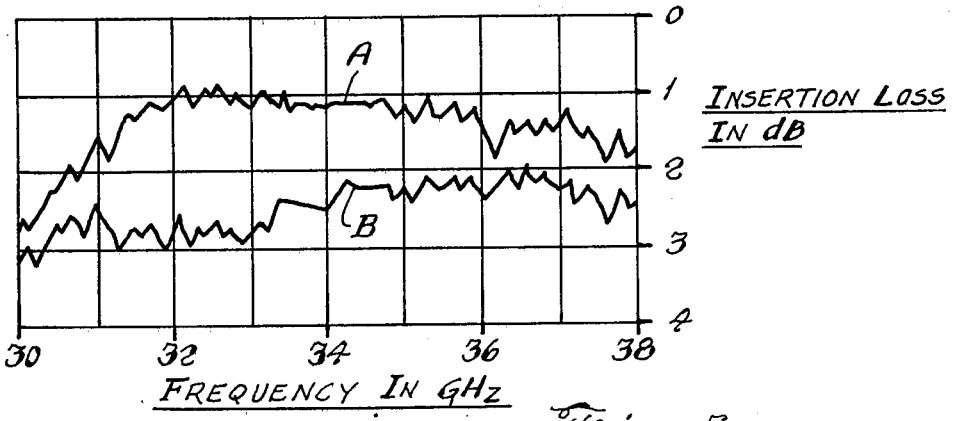
FIG. 5 represents a photo of an oscillograph illustrating the effect on insertion loss of the addition of tuning legs.

The efficacy of tuning cap 26 is illustrated in FIG. 5. Illustrated is a representation of an oscillograph photo which was taken showing insertion loss of a dielectric waveguide circulator with the tuning cap, curve A; and without the tuning cap, curve B. As is shown, the loss of the unit is reduced from ~2.5 dB to ~1 dB over a 3 GHz operational bandwidth centered at 34 GHz. The isolation of the circulator was not appreciably altered.

Although the desired relationship between dielectric constants of the support plate 10 and waveguides 12, 14 and 16 has been thoroughly described in the aforementioned U.S. patent application Ser. No. 394,753, in the embodiment of the present invention which was fabricated, the dielectric constant of the support plate was $\epsilon'=2.2$, while that of the waveguides was $\epsilon'=16$. In general, however, the support plate may have a dielectric constant of from $\epsilon'=2$ to $\epsilon'=4.3$, while the waveguides should have a dielectric constant greater than $\epsilon'=12$ and less than $\epsilon'=18$.

The structure disclosed achieves the desired result of reducing insertion loss with only the addition of the cap with integral tuning legs. Since the cap also serves as the support for the upper magnet, it adds little in the way of cost or complexity to the structure.

Although a particular embodiment of a biasing magnet holder-tuning cap for a dielectric waveguide circulator has been illustrated and described, it will be obvious that changes and modifications can be made without departing from the spirit of the invention and the scope of the appended claims.

I claim:

1. A millimeter wavelength dielectric waveguide circulator comprising:

a dielectric support plate;

a ferrite junction having a plurality of sides with its bottom bonded to said support plate;

a plurality of dielectric waveguides bonded to said support plate;

each of said dielectric waveguides having one end bonded to a side of said ferrite junction;

at least one metal tuning leg positioned between but spaced from two adjacent dielectric waveguides;

a metal cap positioned above said junction supported by said at least one tuning leg and providing support for a first magnet; and a second magnet bonded to the bottom of said dielectric support plate below said junction.

2. A millimeter wavelength dielectric waveguide circulator in accordance with claim 1 wherein:

the sides of said at least one tuning leg adjacent to said dielectric waveguides are parallel thereto.

3. A millimeter wavelength dielectric waveguide circulator in accordance with claim 1 wherein:

said metal cap and said first magnet are circular and centered over said ferrite junction; and said second magnet is circular and centered under said ferrite junction.

4. A millimeter wavelength dielectric waveguide circulator in accordance with claim 1 wherein:

said ferrite junction is a right, triangular prism having a dielectric waveguide bonded to each of its three sides, thereby forming a Y-junction circulator.

5. A millimeter wavelength dielectric waveguide circulator in accordance with claim 4 wherein:

there is a tuning leg positioned between adjacent dielectric waveguides.

6. A millimeter wavelength dielectric waveguide circulator in accordance with claim 5 wherein:

said metal cap is made integral with said tuning legs.

7. A millimeter wavelength dielectric waveguide Y-junction circulator comprising:

a dielectric support plate having a dielectric constant of from $\epsilon'=2$ to $\epsilon'=4.3$;

a right triangular ferrite prism having its base bonded to said support plate;

three dielectric waveguides, each having one end bonded to a face of said prism;

said dielectric waveguides having a dielectric constant greater than $\epsilon'=12$ and less than $\epsilon'=18$;

said dielectric waveguides bonded on said dielectric support plate so as to have equal angles between adjacent dielectric waveguides;

a metal tuning leg positioned between each pair of adjacent dielectric waveguides;

said tuning legs being spaced from said dielectric waveguides and extending higher than said dielectric waveguides;

a metal cap supported by said tuning legs and having a dished portion on its upper surface above said prism;

a first magnet positioned in said dished portion of said metal cap; and a second magnet bonded to the bottom of said dielectric support plate below said prism.

8. A millimeter wavelength dielectric waveguide Y-junction circulator in accordance with claim 7 wherein:

said metal tunings legs are made integral with said cap.

* * * * *